US007591149B2

(12) United States Patent
Ransbarger et al.

(10) Patent No.: US 7,591,149 B2
(45) Date of Patent: Sep. 22, 2009

(54) LNG SYSTEM WITH ENHANCED REFRIGERATION EFFICIENCY

(75) Inventors: Weldon L. Ransbarger, Houston, TX (US); Bobby D. Martinez, Missouri City, TX (US); Attilio J. Praderio, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 380 days.

(21) Appl. No.: 11/459,500

(22) Filed: Jul. 24, 2006

(65) Prior Publication Data

US 2008/0016908 A1 Jan. 24, 2008

(51) Int. Cl.
*F25J 3/00* (2006.01)

(52) U.S. Cl. ..... 62/612; 62/611

(58) Field of Classification Search ..... 62/611, 62/612

See application file for complete search history.

(56) References Cited

U.S. PATENT DOCUMENTS

| | | | | |
|---|---|---|---|---|
| 3,763,658 | A * | 10/1973 | Gaumer et al. | 62/612 |
| 4,229,195 | A * | 10/1980 | Forg | 62/612 |
| 6,131,407 | A | 10/2000 | Wissolik | |
| 6,449,984 | B1 * | 9/2002 | Paradowski | 62/613 |
| 6,658,890 | B1 | 12/2003 | Hahn et al. | |
| 6,705,113 | B2 * | 3/2004 | Wei et al. | 62/612 |
| 6,793,712 | B2 * | 9/2004 | Qualls | 95/92 |
| 2002/0174679 | A1 * | 11/2002 | Wei | 62/612 |
| 2004/0255616 | A1 * | 12/2004 | Maunder et al. | 62/611 |

FOREIGN PATENT DOCUMENTS

| | | |
|---|---|---|
| EP | 0296313 | 12/1988 |
| WO | WO 2004/040212 | 5/2004 |

* cited by examiner

*Primary Examiner*—William C Doerrler

(57) ABSTRACT

Cascade-type natural gas liquefaction methods and apparatus are provided, having enhanced thermodynamic efficiencies, through the use of added refrigeration levels in one or both of the ethylene and methane refrigeration systems thereof.

41 Claims, 1 Drawing Sheet

LNG SYSTEM WITH ENHANCED REFRIGERATION EFFICIENCY

BACKGROUND OF THE INVENTION

1. Field of the Invention

Figure 1:
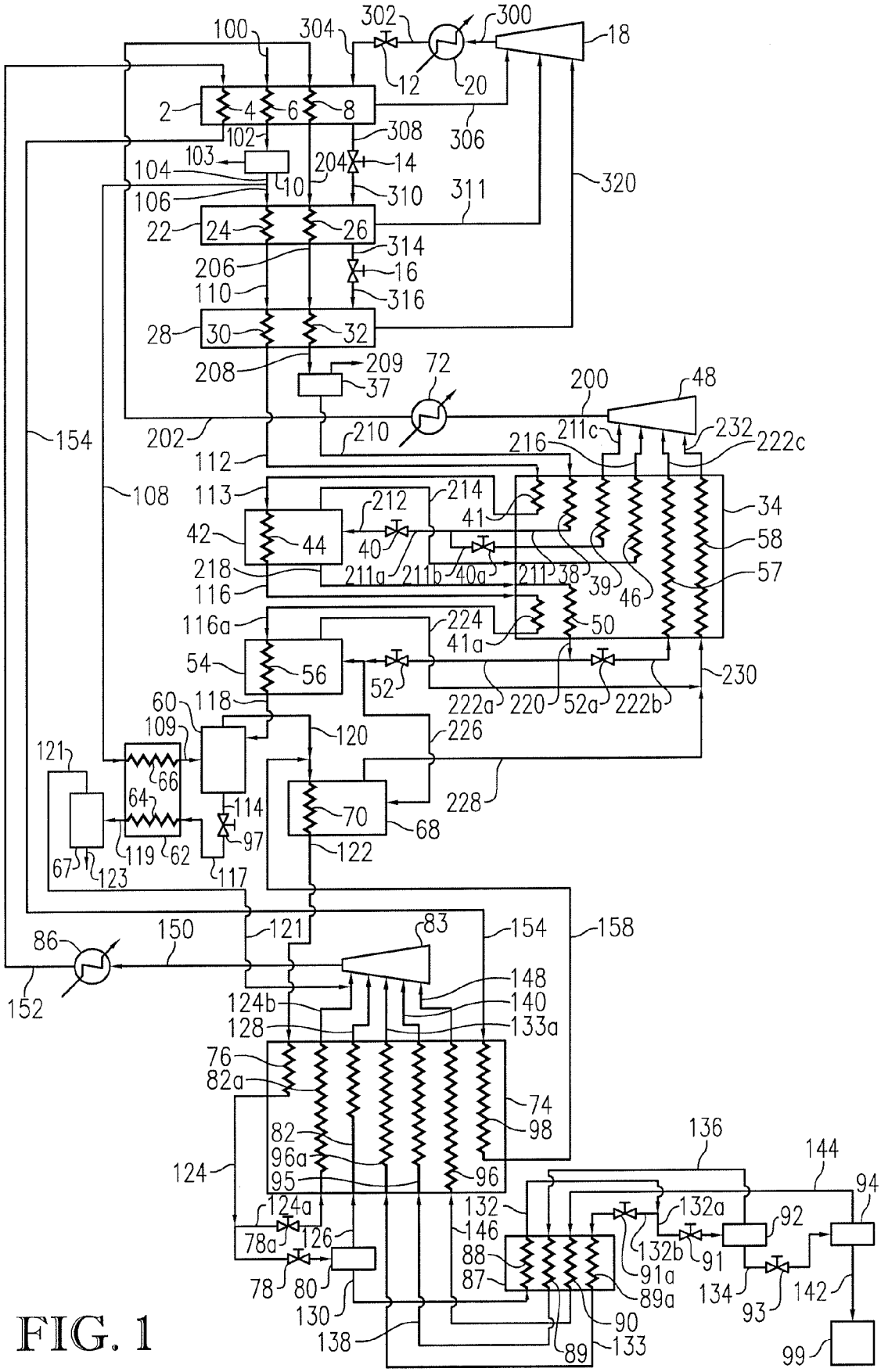

This invention relates to a method and apparatus for liquefying natural gas. In particular, the invention concerns an improved cascade-type liquefied natural gas (LNG) facility employing additional refrigeration levels in the heat exchanging economizers of one or both of the ethylene and methane refrigeration cycles, thereby enhancing thermodynamic efficiencies without significant additional capital cost.

2. Description of the Prior Art

The cryogenic liquefaction of natural gas is routinely practiced as a means of converting natural gas into a more convenient form for transportation and storage. Such liquefaction reduces the volume of the natural gas by about 600-fold and results in a product which can be stored and transported at near atmospheric pressure.

Natural gas is frequently transported by pipeline from the supply source to a distant market. It is desirable to operate the pipeline under a substantially constant and high load factor but often the deliverability or capacity of the pipeline will exceed demand while at other times the demand may exceed the deliverability of the pipeline. In order to shave off the peaks where demand exceeds supply or the valleys when supply exceeds demand, it is desirable to store the excess gas in such a manner that it can be delivered when demand exceeds supply. Such practice allows future demand peaks to be met with material from storage. One practical means for doing this is to convert the gas to a liquefied state for storage and to then vaporize the liquid as demand requires.

The liquefaction of natural gas is of even greater importance when transporting gas from a supply source which is separated by great distances from the candidate market and a pipeline either is not available or is impractical. This is particularly true where transport must be made by ocean-going vessels. Ship transportation in the gaseous state is generally not practical because appreciable pressurization is required to significantly reduce the specific volume of the gas. Such pressurization requires the use of more expensive storage containers.

In order to store and transport natural gas in the liquid state, the natural gas is preferably cooled to −240° F. to −260° F. where the liquefied natural gas (LNG) possesses a near-atmospheric vapor pressure. Numerous systems exist in the prior art for the liquefaction of natural gas in which the gas is liquefied by sequentially passing the gas at an elevated pressure through a plurality of cooling stages whereupon the gas is cooled to successively lower temperatures until the liquefaction temperature is reached. Cooling is generally accomplished by indirect heat exchange with one or more refrigerants such as propane, propylene, ethane, ethylene, methane, nitrogen, carbon dioxide, or combinations of the preceding refrigerants (e.g., mixed refrigerant systems). A liquefaction methodology which is particularly applicable to the current invention employs an open methane cycle for the final refrigeration cycle wherein a pressurized LNG-bearing stream is flashed and the flash vapors (i.e., the flash gas stream(s)) are subsequently employed as cooling agents, recompressed, cooled, combined with the processed natural gas feed stream and liquefied thereby producing the pressurized LNG-bearing stream.

Currently, the methane refrigeration systems of cascade-type LNG processes are designed so that the natural gas feed stream leaves the ethylene cooling system as a subcooled liquid and enters the methane system for further subcooling. The feed stream is subcooled by the vapors generated from lower-stage flashes and is then expanded into a high-pressure flash drum. The stream changes from a subcooled liquid stream to a liquid/vapor mixture at lower pressure. The vapor phase is returned through the methane economizer where it extracts heat from the predominantly methane feed and is ultimately directed to the methane compressor for recompression. The liquid fraction leaves the high-stage flash drum and enters another economizer stage where it transfers heat to lower-stage flash vapors. The stream is then expanded via an expansion valve into an intermediate-stage flash drum where the stream changes from a subcooled liquid to a vapor/liquid mixture which is separated in the intermediate-stage flash drum. The vapor leaves the intermediate-stage flash drum and is directed through the economizers wherein it extracts heat from the processed natural gas feed and is ultimately recompressed in the methane compressor. The liquid leaving the intermediate-stage flash drum is then expanded and introduced into a low-stage flash drum. The vapor leaves the low-stage flash drum and passes through the economizers, where it extracts heat from the processed natural feed and is then recompressed. The liquid leaves the low-stage flash drum to LNG storage.

In the ethylene refrigeration systems of conventional LNG processes, the ethylene refrigerant is condensed in the propane refrigeration system. Thereafter, the ethylene is subcooled in the ethylene economizer and is then expanded into the high-stage ethylene chiller where it is used to cool the natural gas feed.

Designers of LNG processes are constantly seeking ways to improve the thermodynamic efficiencies of the systems. While in theory this can be accomplished by providing additional refrigeration capacity, there is a point of diminishing returns where the capital costs associated with the added capacity are greater than the return. Therefore, the goal is to have maximum thermodynamic efficiencies coupled with the lowest possible costs.

OBJECTS AND SUMMARY OF THE INVENTION

It is, therefore, an object of the present invention to provide a novel natural gas liquefaction system that is characterized by high thermodynamic efficiency with only minimal additional capital cost.

A further object of the invention is to provide an LNG process which derives increased thermodynamic efficiency in both the ethylene and methane cooling systems thereof, by the addition of extra cooling stages within the system economizers.

Another object of the invention is to provide such cooling system efficiencies with only a minimum of additional equipment, as compared with present-day ethylene and methane cooling systems.

It should be understood that the above objects are exemplary and need not all be accomplished by the invention claimed herein. Other objects and advantages of the invention will be apparent from the written description and drawings.

Accordingly, one aspect of the present invention concerns a process for liquefying a predominantly methane stream comprising the following steps: (a) generating at least four distinct refrigerant streams from a common first refrigerant stream; and (b) cooling at least a portion of the predominantly methane stream via indirect heat exchange with at least a portion of each of the distinct refrigerant streams.

Another aspect of the present invention concerns a process of liquefying a natural gas stream comprising the following steps: (a) cooling at least a portion of the natural gas stream via indirect heat exchange with a refrigerant in a first heat exchanging chiller; (b) generating at least three distinct refrigerant streams from the refrigerant employed in the first heat exchanging chiller; and (c) cooling at least a portion of the natural gas via indirect heat exchange with at least a portion of each of the distinct refrigerant streams in a heat exchanging economizer different than the first heat exchanging chiller.

A further aspect of the present invention concerns an apparatus for liquefying a predominantly methane stream. The apparatus includes first and second mechanical refrigeration cycles. The first mechanical refrigeration cycle employs a first refrigerant to cool at least a portion of the predominantly methane stream. The second mechanical refrigeration cycle employs a second refrigerant to cool at least a portion of the predominantly methane stream downstream of the first refrigeration cycle. At least one of the first and second mechanical refrigeration cycles includes a heat exchanging economizer defining at least one cooling pass through which at least a portion of the predominately methane stream flows and at least four warming passes though which at least four distinct refrigerant streams flow. The heat exchanging economizer facilitates indirect heat exchange between the predominately methane stream and each of said four distinct refrigerant streams.

BRIEF DESCRIPTION OF THE DRAWING FIGURE

A preferred embodiment of the present invention is described below with reference to the attached drawing FIGURE wherein:

FIG. 1 is a simplified flow diagram of a cascaded refrigeration process for LNG production which employs enhanced refrigeration apparatus.

DETAILED DESCRIPTION OF THE PREFERRED EMBODIMENT

A cascaded refrigeration process uses one or more refrigerants for transferring heat energy from the natural gas stream to the refrigerant and ultimately transferring said heat energy to the environment. In essence, the overall refrigeration system functions as a heat pump by removing heat energy from the natural gas stream as the stream is progressively cooled to lower and lower temperatures. The design of a cascaded refrigeration process involves a balancing of thermodynamic efficiencies and capital costs. In heat transfer processes, thermodynamic irreversibilities are reduced as the temperature gradients between heating and cooling fluids become smaller, but obtaining such small temperature gradients generally requires significant increases in the amount of heat transfer area, major modifications to various process equipment, and the proper selection of flow rates through such equipment so as to ensure that both flow rates and approach and outlet temperatures are compatible with the required heating/cooling duty.

As used herein, the term "open-cycle cascaded refrigeration process" refers to a cascaded refrigeration process comprising at least one closed mechanical refrigeration cycle and one open mechanical refrigeration cycle where the boiling point of the refrigerant/cooling agent employed in the open cycle is less than the boiling point of the refrigerating agent or agents employed in the closed cycle(s) and a portion of the cooling duty to condense the compressed open-cycle refrigerant/cooling agent is provided by one or more of the closed cycles. In the current invention, a predominately methane stream is employed as the refrigerant/cooling agent in the open cycle. This predominantly methane stream originates from the processed natural gas feed stream and can include the compressed open methane cycle gas streams. As used herein, the terms "predominantly," "primarily," "principally," and "in major portion," when used to describe the presence of a particular component of a fluid stream, shall mean that the fluid stream comprises at least 50 mole percent of the stated component. For example, a "predominantly" methane stream, a "primarily" methane stream, a stream "principally" comprised of methane, or a stream comprised "in major portion" of methane each denote a stream comprising at least 50 mole percent methane.

One of the most efficient and effective means of liquefying natural gas is via an optimized cascade-type operation in combination with expansion-type cooling. Such a liquefaction process involves the cascade-type cooling of a natural gas stream at an elevated pressure, (e.g., about 650 psia) by sequentially cooling the gas stream via passage through a multi-stage propane cycle, a multi-stage ethane or ethylene cycle, and an open-end methane cycle which utilizes a portion of the feed gas as a source of methane and which includes therein a multi-stage expansion cycle to further cool the same and reduce the pressure to near-atmospheric pressure. In the sequence of cooling cycles, the refrigerant having the highest boiling point is utilized first followed by a refrigerant having an intermediate boiling point and finally by a refrigerant having the lowest boiling point. As used herein, the terms "upstream" and "downstream" shall be used to describe the relative positions of various components of a natural gas liquefaction plant along the flow path of natural gas through the plant.

Various pretreatment steps provide a means for removing certain undesirable components (e.g., acid gases, mercaptan, mercury, and moisture) from the natural gas feed stream delivered to the LNG facility. The composition of this gas stream may vary significantly. As used herein, a natural gas stream is any stream principally comprised of methane which originates in major portion from a natural gas feed stream, such feed stream for example containing at least 85 mole percent methane, with the balance being ethane, higher hydrocarbons, nitrogen, carbon dioxide, and a minor amount of other contaminants such as mercury, hydrogen sulfide, and mercaptan. The pretreatment steps may be separate steps located either upstream of the cooling cycles or located downstream of one of the early stages of cooling in the initial cycle. The following is a non-inclusive listing of some of the available means which are readily known to one skilled in the art. Acid gases and to a lesser extent mercaptan are routinely removed via a chemical reaction process employing an aqueous amine-bearing solution. This treatment step is generally performed upstream of the cooling stages in the initial cycle. A major portion of the water is routinely removed as a liquid via two-phase gas-liquid separation following gas compression and cooling upstream of the initial cooling cycle and also downstream of the first cooling stage in the initial cooling cycle. Mercury is routinely removed via mercury sorbent beds. Residual amounts of water and acid gases are routinely removed via the use of properly selected sorbent beds such as regenerable molecular sieves.

The pretreated natural gas feed stream is generally delivered to the liquefaction process at an elevated pressure or is compressed to an elevated pressure generally greater than 500 psia, preferably about 500 psia to about 3000 psia, still more preferably about 500 psia to about 1000 psia, still yet more preferably about 600 psia to about 800 psia. The feed stream temperature is typically near ambient to slightly above ambient. A representative temperature range being 60° F. to 150° F.

As previously noted, the natural gas feed stream is cooled in a plurality of multistage refrigeration cycles or steps (preferably three) by indirect heat exchange with a plurality of different refrigerants (preferably three). Preferably, each of the refrigerants associated with each refrigeration cycle is a single component refrigerant (i.e., not a mixed refrigerant). The overall cooling efficiency for a given cycle improves as the number of stages increases but this increase in efficiency is accompanied by corresponding increases in net capital cost and process complexity. The feed gas is preferably passed through an effective number of refrigeration stages (nominally two, preferably two to four, and more preferably three stages) in the first closed mechanical refrigeration cycle utilizing a relatively high boiling refrigerant. Such relatively high boiling point refrigerant is preferably comprised in major portion of propane, propylene, or mixtures thereof, more preferably the refrigerant comprises at least about 75 mole percent propane, even more preferably at least 90 mole percent propane, and most preferably the refrigerant consists essentially of propane. Thereafter, the processed feed gas flows through an effective number of stages (nominally three, preferably three to six, and more preferably three to five) in a second closed mechanical refrigeration cycle in heat exchange with a refrigerant having a lower boiling point. Such lower boiling point refrigerant is preferably comprised in major portion of ethane, ethylene, or mixtures thereof, more preferably the refrigerant comprises at least about 75 mole percent ethylene, even more preferably at least 90 mole percent ethylene, and most preferably the refrigerant consists essentially of ethylene. Each cooling stage comprises a separate cooling zone. As previously noted, the processed natural gas feed stream is preferably combined with one or more recycle streams (i.e., compressed open methane cycle gas streams) at various locations in the second refrigeration cycle thereby producing a liquefaction stream. In the last stage of the second cooling cycle, the liquefaction stream is condensed (i.e., liquefied) in major portion, preferably in its entirety, thereby producing a pressurized LNG-bearing stream. Generally, the process pressure at this location is only slightly lower than the pressure of the pretreated feed gas to the first stage of the first mechanical refrigeration cycle.

After being processed in the second mechanical refrigeration cycle, the pressurized LNG-bearing stream is then further cooled in a third refrigeration cycle referred to as the open methane cycle via contact in a methane economizer with flash gases generated in this third cycle in a manner to be described later and via sequential expansion of the pressurized LNG-bearing stream to near atmospheric pressure. The flash gasses used as a refrigerant in the third refrigeration cycle are preferably comprised in major portion of methane, more preferably the flash gas refrigerant comprises at least 75 mole percent methane, still more preferably at least 90 mole percent methane, and most preferably the refrigerant consists essentially of methane. During expansion of the pressurized LNG-bearing stream to near atmospheric pressure, the pressurized LNG-bearing stream is preferably cooled via at least three sequential expansions where each expansion employs an expansion device as a pressure reduction means. Suitable expansion devices include, for example, either Joule-Thomson expansion valves or hydraulic expanders. The expansion is followed by a separation of the gas-liquid product with a separator. When a hydraulic expander is employed and properly operated, the greater efficiencies associated with the recovery of power, a greater reduction in stream temperature, and the production of less vapor during the flash expansion step will frequently more than off-set the higher capital and operating costs associated with the expander. In one embodiment, additional cooling of the pressurized LNG-bearing stream prior to flashing is made possible by first flashing a portion of this stream via one or more hydraulic expanders and then via indirect heat exchange means employing the flash gas stream to cool the remaining portion of the pressurized LNG-bearing stream prior to flashing. The warmed flash gas stream is then recycled via return to an appropriate location, based on temperature and pressure considerations, in the open methane cycle and will be recompressed.

The liquefaction process described herein may use one of several types of cooling which include but are not limited to (a) indirect heat exchange, (b) vaporization, and (c) expansion or pressure reduction. Indirect heat exchange, as used herein, refers to a process wherein the refrigerant cools the substance to be cooled without actual physical contact between the refrigerating agent and the substance to be cooled. Specific examples of indirect heat exchange means include heat exchange undergone in a shell-and-tube heat exchanger, a core-in-kettle heat exchanger, and a brazed aluminum plate-fin heat exchanger. The physical state of the refrigerant and substance to be cooled can vary depending on the demands of the system and the type of heat exchanger chosen. Thus, a shell-and-tube heat exchanger will typically be utilized where the refrigerating agent is in a liquid state and the substance to be cooled is in a liquid or gaseous state or when one of the substances undergoes a phase change and process conditions do not favor the use of a core-in-kettle heat exchanger. As an example, aluminum and aluminum alloys are preferred materials of construction for the core but such materials may not be suitable for use at the designated process conditions. A plate-fin heat exchanger will typically be utilized where the refrigerant is in a gaseous state and the substance to be cooled is in a liquid or gaseous state. Finally, the core-in-kettle heat exchanger will typically be utilized where the substance to be cooled is liquid or gas and the refrigerant undergoes a phase change from a liquid state to a gaseous state during the heat exchange. Certain portions of the present disclosure describe indirect heat exchange that is carried out in heat exchanging "chillers" and heat exchanging "economizers." Such chillers and economizers can have any configuration that facilitates indirect heat exchange between fluids passed therethrough. In a preferred embodiment of the present invention, the chillers have a core-in-kettle configuration while the economizers have a plate-fin configuration.

Vaporization cooling refers to the cooling of a substance by the evaporation or vaporization of a portion of the substance with the system maintained at a constant pressure. Thus, during the vaporization, the portion of the substance which evaporates absorbs heat from the portion of the substance which remains in a liquid state and hence, cools the liquid portion.

Expansion or pressure reduction cooling refers to cooling which occurs when the pressure of a gas, liquid, or a two-phase system is decreased by passing through a pressure-reducing expansion device. In one embodiment, this expansion device is a Joule-Thomson expansion valve. In another embodiment, the expansion device is either a hydraulic or gas expander. Because expanders recover work energy from the expansion process, lower process stream temperatures are possible upon expansion.

The flow schematic and apparatus set forth in FIG. 1 represents a preferred embodiment of the inventive LNG facility employing enhanced ethylene and methane refrigeration cycles. Those skilled in the art will recognized that FIG. 1 is schematic only and, therefore, many items of equipment that would be needed in a commercial plant for successful operation have been omitted for the sake of clarity. Such items might include, for example, compressor controls, flow and level measurements and corresponding controllers, temperature and pressure controls, pumps, motors, filters, additional heat exchangers, and valves, etc. These items would be provided in accordance with standard engineering practice.

To facilitate an understanding of FIG. 1, the following numbering nomenclature was employed. Items numbered 1 through 99 are process vessels and equipment which are directly associated with the liquefaction process. Items numbered 100 through 199 correspond to flow lines or conduits which contain predominantly methane streams. Items numbered 200 through 299 correspond to flow lines or conduits which contain predominantly ethylene streams. Items numbered 300 through 399 correspond to flow lines or conduits which contain predominantly propane streams.

Referring to FIG. 1, gaseous propane is compressed in a multistage (preferably three-stage) compressor 18 driven by a gas turbine driver (not illustrated). The three stages of compression preferably exist in a single unit although each stage of compression may be a separate unit and the units mechanically coupled to be driven by a single driver. Upon compression, the compressed propane is passed through conduit 300 to a cooler 20 where it is cooled and liquefied. A representative pressure and temperature of the liquefied propane refrigerant prior to flashing is about 100° F. and about 190 psia. The stream from cooler 20 is passed through conduit 302 to a pressure reduction means, illustrated as expansion valve 12, wherein the pressure of the liquefied propane is reduced, thereby evaporating or flashing a portion thereof. The resulting two-phase product then flows through conduit 304 into a high-stage propane chiller 2 wherein gaseous methane refrigerant introduced via conduit 152, natural gas feed introduced via conduit 100, and gaseous ethylene refrigerant introduced via conduit 202 are respectively cooled via indirect heat exchange means 4, 6, and 8, thereby producing cooled gas streams respectively produced via conduits 154, 102, and 204. The gas in conduit 154 is fed to a main methane economizer 74 which will be discussed in greater detail in a subsequent section and wherein the stream is cooled via indirect heat exchange means/pass 98.

The propane gas from chiller 2 is returned to compressor 18 through conduit 306. This gas is fed to the high-stage inlet port of compressor 18. The remaining liquid propane is passed through conduit 308, the pressure further reduced by passage through a pressure reduction means, illustrated as expansion valve 14, whereupon an additional portion of the liquefied propane is flashed. The resulting two-phase stream is then fed to an intermediate-stage propane chiller 22 through conduit 310, thereby providing a coolant for chiller 22. The cooled feed gas stream from chiller 2 flows via conduit 102 to separation equipment 10 wherein gas and liquid phases are separated. The liquid phase, which can be rich in $C_3$+components, is removed via conduit 103. The gas phase is removed via conduit 104 and then split into two separate streams which are conveyed via conduits 106 and 108. The stream in conduit 106 is fed to propane chiller 22, while the stream in conduit 108 becomes the feed to heat exchanger 62 and ultimately becomes the stripping gas to heavies removal column 60, discussed in more detail below. Ethylene refrigerant from chiller 2 is introduced to chiller 22 via conduit 204. In chiller 22, the feed gas stream, also referred to herein as a methane-rich stream, and the ethylene refrigerant streams are respectively cooled via indirect heat transfer means 24 and 26, thereby producing cooled methane-rich and ethylene refrigerant streams via conduits 110 and 206. The thus evaporated portion of the propane refrigerant in chiller 22 is separated and passed through conduit 311 to the intermediate-stage inlet of compressor 18. Liquid propane refrigerant from chiller 22 is removed via conduit 314, flashed across a pressure reduction means, illustrated as expansion valve 16, and then fed to a low-stage propane chiller/condenser 28 via conduit 316.

As illustrated in FIG. 1, the methane-rich stream flows from intermediate-stage propane chiller 22 to the low-stage propane chiller 28 via conduit 110. In chiller 28, the stream is cooled via indirect heat exchange means 30. In a like manner, the ethylene refrigerant stream flows from the intermediate-stage propane chiller 22 to low-stage propane chiller 28 via conduit 206. In the latter, the ethylene refrigerant is totally condensed or condensed in nearly its entirety via indirect heat exchange means 32. The vaporized propane is removed from low-stage propane chiller 28 and returned to the low-stage inlet of compressor 18 via conduit 320.

The methane-rich stream exiting low-stage propane chiller 28 in conduit 112 enters the ethylene refrigeration cycle where it first passes through a feed cooling pass/exchanger 41 of an ethylene economizer 34 for cooling via indirect heat exchange with four distinct ethylene refrigerant vapor streams flowing through warming passes 39, 46, 57, and 58 of ethylene economizer 34. As discussed in greater detail below, the ethylene refrigeration cycle employs a unique system for generating the streams processed in warming passes 39, 46, 57, and 58 from the ethylene refrigerant originating from conduit 210. The initially cooled methane-rich stream then exits ethylene economizer 34 via line 113 and is introduced into a high-stage ethylene chiller 42.

Ethylene refrigerant exits low-stage propane chiller 28 via conduit 208 and is preferably fed to a separation vessel 37 wherein light components are removed via conduit 209 and condensed ethylene is removed via conduit 210. The ethylene refrigerant at this location in the process is generally at a temperature of about −24° F. and a pressure of about 285 psia. The ethylene refrigerant then flows through line 210 to ethylene economizer 34 wherein it is cooled in a refrigerant cooling pass/exchanger 38 via indirect heat exchange with the distinct refrigerant streams in warming passes 39, 46, 57, and 58. The resulting cooled ethylene refrigerant stream exits ethylene economizer 34 via conduit 211. The refrigerant stream in conduit 211 is split into two fractions, respectively passing through lines 211*a* and 211*b*. The fraction passing through line 211*a* is directed to a pressure reduction means, illustrated as an expansion valve 40, whereupon the refrigerant is flashed to a preselected temperature and pressure and fed to high-stage ethylene chiller 42 via conduit 212. The remaining fraction is routed via line 211*b* to a pressure reduction means, here illustrated as expansion valve 40*a*, where it is flashed to generate a two-phase stream that is thereafter conducted to warming pass 39 of ethylene economizer 34, where it is employed as a coolant. Preferably, the two-phase stream in conduit 211*b* contains at least about 10 mole percent liquid. In warming pass 39, such liquid boils so that the stream exiting pass 39 is substantially all vapor. The output from warming pass 39 is conveyed via conduit 211*c* to a first stage of ethylene compressor 48.

In high-stage ethylene chiller 42, the methane-rich stream flowing through indirect heat exchange means 44 is cooled by the ethylene refrigerant entering via conduit 212. Vaporized ethylene is removed from chiller 42 via conduit 214 and routed to ethylene economizer 34 wherein the vapor functions as a coolant in warming pass 46. The ethylene vapor is then removed from ethylene economizer 34 via conduit 216 and fed to a second stage of ethylene compressor 48. The ethylene refrigerant which is not vaporized in high-stage ethylene chiller 42 is removed via conduit 218 and returned to ethylene economizer 34 for further cooling in refrigerant cooling pass 50, and is removed from ethylene economizer 34 via conduit 220. This stream is then split into two fractions. One fraction is conveyed via line 222*a* and is flashed in a pressure reduction means, illustrated as expansion valve 52, whereupon the resulting two-phase product is introduced into a low-stage ethylene chiller 54. The other fraction is conveyed in conduit 222*b*, and is flashed in a pressure reduction means, illustrated as expansion valve 52*a*, whereupon the resulting two-phase product is introduced into warming pass 57 of ethylene economizer 34 for use as a coolant. Preferably, the stream in conduit 222*b* contains at least about 10 mole percent liquid. In warming pass 57, such liquid boils so that the stream exiting pass 57 is substantially all vapor. The output from warming pass 57 is directed via conduit 222*c* to a third stage of ethylene compressor 48.

After cooling in indirect heat exchange means 44, the methane-rich stream is removed from high-stage ethylene chiller 42 via conduit 116, and passes through feed cooling pass 41*a* of ethylene economizer 34. The cooled stream then exits economizer 34 via line 116*a* and is introduced into heat exchange means 56 of low-stage ethylene chiller 54 for cooling via indirect heat exchange with the ethylene refrigerant entering via conduit 222*a*. A two-phase stream is produced from heat exchange means 56 of chiller 54 and flows via conduit 118 to a heavies removal column 60. As previously noted, the methane-rich stream in line 104 was split so as to flow via conduits 106 and 108. The contents of conduit 108, which is referred to herein as the stripping gas, is first fed to heat exchanger 62 wherein this stream is cooled via indirect heat exchange means 66 thereby becoming a cooled stripping gas stream which then flows via conduit 109 to heavies removal column 60. A heavies-rich liquid stream containing a significant concentration of $C_4$+hydrocarbons, such as benzene, cyclohexane, other aromatics, and/or heavier hydrocarbon components, is removed from heavies removal column 60 via conduit 114, preferably flashed via a flow control means 97, preferably a control valve which can also function as a pressure reduction, and transported to heat exchanger 62 via conduit 117. Preferably, the stream flashed via flow control means 97 is flashed to a pressure about or greater than the pressure at the high stage inlet port to methane compressor 83. Flashing also imparts greater cooling capacity to the stream. In heat exchanger 62, the stream delivered by conduit 117 provides cooling capabilities via indirect heat exchange means 64 and exits heat exchanger 62 via conduit 119. In heavies removal column 60, the two-phase stream introduced via conduit 118 is contacted with the cooled stripping gas stream introduced via conduit 109 in a countercurrent manner thereby producing a heavies-depleted vapor stream via conduit 120 and a heavies-rich liquid stream via conduit 114.

The heavies-rich stream in conduit 119 is subsequently separated into liquid and vapor portions or preferably is flashed or fractionated in vessel 67. In either case, a heavies-rich liquid stream is produced via conduit 123 and a second methane-rich vapor stream is produced via conduit 121. In the preferred embodiment, the stream in conduit 121 is fed to the high-stage inlet port of the methane compressor 83.

As previously noted, the gas exiting high-stage propane chiller 2 via conduit 154 is fed to main methane economizer 74 wherein the stream is cooled via indirect heat exchange means 98. The resulting cooled compressed methane recycle or refrigerant stream in conduit 158 is combined in the preferred embodiment with the heavies-depleted vapor stream from heavies removal column 60, delivered via conduit 120, and fed to a low-stage ethylene chiller/condenser 68. In ethylene condenser 68, this stream is cooled and condensed via indirect heat exchange means 70 with a fraction of the expanded ethylene refrigerant which is routed to ethylene chiller 68 via conduit 226. The condensed methane-rich product from condenser 68 is delivered via conduit 122. The vaporized ethylene from ethylene chiller 54, withdrawn via conduit 224, and the vaporized ethylene from ethylene condenser 68, withdrawn via conduit 228, are combined and routed, via conduit 230, to ethylene economizer 34 wherein the vapors function as a coolant in warming pass 58. The stream produced from pass 58 is then routed via conduit 232 from ethylene economizer 34 to a fourth stage of ethylene compressor 48. The compressed ethylene product from compressor 48 is routed to a downstream cooler 72 via conduit 200. The product from cooler 72 flows via conduit 202 and is introduced, as previously discussed, to high-stage propane chiller 2.

The pressurized LNG-bearing stream exiting the ethylene refrigeration cycle via conduit 122, preferably a subcooled liquid stream in its entirety, is typically at a temperature in the range of from about −180 to about −75° F., more preferably in the range of from about −150 to about −100° F., most preferably in the range of from −135 to −115° F. The pressure of the stream in conduit 122 is preferably in the range of from about 500 to about 700 psia, most preferably in the range of from 550 to 725 psia.

The stream in conduit 122 is introduced into the methane refrigeration cycle where it is first directed to a main methane economizer 74. In methane economizer 74, the stream passes through feed cooling exchanger/pass 76 wherein it is cooled via indirect exchange with distinct refrigerant streams in warming passes 82, 82*a*, 95, 96, and 96*a*. As discussed in further detail below, the methane refrigeration cycle includes a unique system for generating the distinct refrigerant streams that flow through passes 82, 82*a*, 95, 96, and 96*a* of main methane economizer 74, as well as passes 89, 89*a*, and 90 of secondary methane economizer 87. The cooled stream from pass 76 exits methane economizer 74 via conduit 124. It is preferred for the temperature of the stream in conduit 124 to be at least about 10° F. less than the temperature of the stream in conduit 122, more preferably at least about 20° F. less than the temperature of the stream in conduit 122. Most preferably, the temperature of the stream in conduit 124 is in the range of from about −175 to about −130° F.

The stream in conduit 124 is thereafter separated into two fractions. The first fraction is routed via line 124*a* through a pressure reduction means, here shown as an expansion valve 78*a*, to produce a two-phase stream that is then routed through a warming pass/exchanger 82*a* of main methane economizer 74 to assist in the cooling of the stream in pass 76. Preferably, the stream entering warming pass 82*a* contains at least about 10 mole percent liquid. As the stream flows through pass 82*a* such liquid boils so that the stream exiting pass 82*a* is substantially all vapor. The warmed vapor from pass 82*a* is conveyed via conduit 124*b* to a first stage of methane compressor 83.

The second fraction derived from conduit 124 is directed to a pressure reduction means, illustrated as expansion valve 78, which evaporates or flashes a portion of the liquid stream thereby generating a two-phase stream. The two-phase stream from expansion valve 78 is then passed to high-stage methane flash drum 80 where it is separated into a flash gas stream discharged through conduit 126 and a liquid phase stream discharged through conduit 130. The flash gas stream from flash drum 80 is then transferred to main methane economizer 74 via conduit 126 wherein the stream functions as a coolant in warming pass 82 and aids in the cooling of the stream in cooling pass 76. The warmed refrigerant stream exits heat exchanger pass 82 and methane economizer 74 via conduit 128, and is directed to a second stage of methane compressor 83. The liquid-phase stream exiting high-stage flash drum 80 via conduit 130 is passed through a secondary methane economizer 87 wherein the liquid is further cooled by downstream flash vapors in cooling pass 88. The cooled liquid exits secondary methane economizer 87 via conduit 132 and is split into two portions. One portion is passed via line 132*b* through a pressure reduction means, here illustrated as expansion valve 91*a*, to produce a two-phase stream (containing >10 mole percent liquid) that is thereafter directed through a warming pass 89*a* of secondary methane economizer 87 where it assists in cooling the predominantly methane stream in cooling pass 88, thereby causing the liquid phase of the stream in pass 89*a* to boil. The output from pass 89*a* is conveyed through line 133 to warming pass 96*a* of main methane economizer 74 where it is employed to cool the stream in cooling pass 76. The vapor output from warming pass 96*a* is routed via line 133*a* to a third stage of methane compressor 83.

The second portion derived from conduit 132 is conveyed via conduit 132*a* and is expanded or flashed via pressure reduction means, illustrated as expansion valve 91, to further reduce the pressure and, at the same time, vaporize a portion thereof. The resulting two-phase stream is passed to an intermediate-stage methane flash drum 92 where the stream is separated into a gas phase passing through conduit 136 and a liquid phase passing through conduit 134. The gas phase flows through conduit 136 to warming pass 89 of secondary methane economizer 87 wherein the vapor helps cool the stream in pass 88. Conduit 138 serves as a flow conduit between warming pass 89 in secondary methane economizer 87 and warming pass 95 in main methane economizer 74. The refrigerant stream in warming pass 95 helps cool the predominately methane stream in pass 76. The warmed vapor stream from warming pass 95 exits main methane economizer 74 via conduit 140 and is directed to a fourth stage of methane compressor 83.

The liquid phase exiting intermediate-stage flash drum 92 via conduit 134 is further reduced in pressure by passage through a pressure reduction means, illustrated as a expansion valve 93. The two-phase stream from expansion valve 93 is passed to a final or low-stage flash drum 94. In flash drum 94, a vapor phase is separated and passed through conduit 144 to secondary methane economizer 87 wherein the vapor functions as a coolant via warming pass 90, exits secondary methane economizer 87 via conduit 146, which is connected to the first methane economizer 74 wherein the vapor functions as a coolant in warming pass 96. The warmed vapor stream from pass 96 exits main methane economizer 74 via conduit 148 and is directed to a fifth stage of methane compressor 83.

Compressed methane gas is discharged from methane compressor through conduit 150, is cooled in cooler 86, and is routed to the high pressure propane chiller 2 via conduit 152 as previously discussed. The stream is cooled in chiller 2 via indirect heat exchange means 4 and flows to main methane economizer 74 via conduit 154. The compressed open methane cycle gas stream from chiller 2 which enters the main methane economizer 74 undergoes cooling in its entirety via flow through indirect heat exchange means 98. This cooled stream is then removed via conduit 158 and combined with the processed natural gas feed stream upstream of the first stage of ethylene cooling.

The liquefied natural gas product from low-stage flash drum 94, which is at approximately atmospheric pressure, is passed through conduit 142 to an LNG storage tank 99. In accordance with conventional practice, the liquefied natural gas in storage tank 99 can be transported to a desired location (typically via an ocean-going LNG tanker). The LNG can then be vaporized at an onshore LNG terminal for transport in the gaseous state via conventional natural gas pipelines.

In one embodiment of the present invention, main methane economizer 74 and secondary methane economizer 87 are combined into a single unit (e.g., a single plate-fin heat exchanger with multiple passes). In such a configuration, the combined methane economizer receives five distinct methane refrigerant streams via conduits 124*a*, 126, 132*b*, 136, and 144. The distinct methane refrigerant streams in conduits 124*a*, 126, 132*b*, 136, and 144 preferably each have different temperatures and pressures. In addition, it is preferred for the four distinct ethylene refrigerant streams introduced into ethylene economizer 34 via conduits 211*b*, 214, 222*b*, and 230 to each have different temperatures and pressures. Preferably, the minimum temperature difference between any two of the distinct refrigerant streams fed to an economizer (ethylene and/or methane economizer) is about 5° F., more preferably about 10° F., and most preferably 15° F., while the minimum pressure difference is about 25 psi, 50 psi, or 75 psi.

The preferred forms of the invention described above are to be used as illustration only, and should not be used in a limiting sense to interpret the scope of the present invention. Obvious modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A process for liquefying a predominantly methane stream, said process comprising:(a) generating at least four distinct refrigerant streams from a common first refrigerant stream; and (b) cooling at least a portion of said predominantly methane stream via indirect heat exchange with at least a portion of each of said four distinct refrigerant streams, wherein said four distinct refrigerant streams consist essentially of methane, ethane and/or ethylene.

2. The process of claim 1, wherein said cooling of step (b) is carried out in at least one heat exchanging economizer having a separate pass for each of said four distinct refrigerant streams and wherein said heat exchanging economizer comprises a plate-fin heat exchanger.

3. The process of claim 1, wherein each of said distinct refrigerant streams has an initial temperature measured immediately prior to being used for said cooling of step (b) and wherein the initial temperature of each of said four distinct refrigerant streams is different.

4. The process of claim 1, wherein each of said four distinct refrigerant streams has an initial pressure measured immediately prior to being used for said cooling of step (b) and wherein the initial pressure of each of said four distinct refrigerant streams is different.

5. The process of claim 1, wherein at least a portion of said four distinct refrigerant streams are generated via expansion of at least a portion of said predominantly methane stream after said cooling of step (b).

6. The process of claim 1, wherein all of said four distinct refrigerant streams are expanded prior to being used for said cooling of step (b).

7. The process of claim 1, wherein at least two of said four distinct refrigerant streams are generated at least in part via expansion in serially connected expansion devices.

8. The process of claim 1, further comprising introducing at least a portion of each of said four distinct refrigerant streams into a compressor after using said four distinct refrigerant streams for said cooling of step (b).

9. The process of claim 1, wherein at least one of said distinct refrigerant streams comprises a liquid fraction and wherein said cooling of step (b) causes boiling of said liquid fraction.

10. The process of claim 1, wherein said first refrigerant stream is not a mixed refrigerant.

11. The process of claim 1, wherein said first refrigerant stream comprises predominately methane, ethane, and/or ethylene.

12. The process of claim 1, wherein said first refrigerant stream comprises predominately ethylene.

13. The process of claim 12, further comprising cooling said predominately methane stream via indirect heat exchange with a predominately methane refrigerant subsequent to said cooling of step (b) and cooling said predominately methane stream via indirect heat exchange with a predominately propane refrigerant prior to said cooling of step (b).

14. The process of claim 1, wherein said first refrigerant stream comprises predominately methane.

15. The process of claim 14, further comprising cooling said predominately methane stream via indirect heat exchange with a predominately propane, propylene, ethane, and/or ethylene refrigerant prior to said cooling of step (b).

16. The process of claim 1, where said first refrigerant stream comprises a portion of said predominantly methane stream.

17. The process of claim 1, wherein said generating of step (a) includes splitting at least a portion of said predominately methane stream into first and second fractions after said cooling of step (b), using at least a portion of said first fraction as a first one of said four distinct refrigerant streams, and using at least a portion of said second fraction to generate at least one other of said four distinct refrigerant streams.

18. The process of claim 17, wherein said generating of step (a) includes expanding at least a portion of said second fraction, phase separating the resulting expanded stream to thereby produce a third predominately vapor fraction and a fourth predominately liquid fraction, wherein at least a portion of said third predominately vapor fraction is used as a second one of said four distinct refrigerant streams.

19. The process of claim 18, wherein said generating of step (a) includes splitting at least a portion of said fourth predominately liquid fraction into fifth and sixth fractions, using at least a portion of said fifth fraction as a third one of said four distinct refrigerant streams.

20. The process of claim 19, wherein said generating of step (a) includes expanding at least a portion of said sixth fraction, phase separating the resulting expanded stream to thereby produce a seventh predominately vapor fraction and an eighth predominately liquid fraction, wherein at least a portion of said seventh predominately vapor fraction is used as a fourth one of said four distinct refrigerant streams.

21. The process of claim 20, wherein said generating step (a) includes expanding at least a portion of said eighth predominately liquid fraction, phase separating the resulting expanded stream to thereby produce a ninth predominately vapor fraction and a tenth predominately liquid fraction, wherein at least a portion of said ninth predominately vapor fraction is used as a fifth one of said distinct refrigerant streams.

22. The process of claim 21, further comprising recovering LNG from said tenth predominately liquid fraction.

23. The process of claim 1, further comprising vaporizing LNG produced in accordance with the process of claim 1.

24. A process of liquefying a natural gas stream, said process comprising:(a) cooling at least a portion of said natural gas stream via indirect heat exchange with a refrigerant in a first heat exchanging chiller;(b) generating at least three distinct refrigerant streams from said refrigerant employed in said first heat exchanging chiller; and(c) cooling at least a portion of said natural gas via indirect heat exchange with at least a portion of each of said distinct refrigerant streams in a heat exchanging economizer different than said first heat exchanging chiller.

25. The process of claim 24, wherein said first heat exchanging chiller comprises a core-in-kettle heat exchanger and said heat exchanging economizer comprises a plate-fin heat exchanger.

26. The process of claim 24, wherein each of said distinct refrigerant streams enters said heat exchanging economizer at a different temperature and pressure.

27. The process of claim 24, further comprising cooling at least a portion of said natural gas stream via indirect heat exchange with at least a portion of said refrigerant in a second heat exchanging chiller different than said first heat exchanging chiller.

28. The process of claim 27, wherein at least a portion of at least one of said distinct refrigerant streams is derived from the refrigerant employed in said second heat exchanging chiller.

29. The process of claim 24, wherein said refrigerant is not a mixed refrigerant.

30. The process of claim 24, wherein said refrigerant comprises predominately ethane and/or ethylene.

31. The process of claim 24, further comprising cooling at least a portion of said natural gas via indirect heat exchange with a predominately propane and/or propylene refrigerant prior to said cooling of step (a) and cooling at least a portion of said natural gas stream via indirect heat exchange with a predominately methane refrigerant subsequent to said cooling of step (a).

32. The process of claim 24, further comprising vaporizing LNG produced in accordance with the process of claim 24.

33. An apparatus for liquefying a predominantly methane stream, said apparatus comprising: a first mechanical refrigeration cycle employing a first refrigerant to cool at least a portion of said predominantly methane stream; and a second mechanical refrigeration cycle employing a second refrigerant to cool at least a portion of said predominantly methane stream downstream of said first mechanical refrigeration cycle, wherein at least one of said first and second mechanical refrigeration cycles includes a heat exchanging economizer, wherein said heat exchanging economizer defines at least one cooling pass for receiving a flow of said predominately methane stream and at least four warming passes for receiving a flow of at least four distinct refrigerant streams, wherein said heat exchanging economizer facilitates indirect heat exchange between said predominately methane stream in said cooling pass and each of said four distinct refrigerant streams in said warming passes.

34. The apparatus of claim 33, wherein said heat exchanging economizer comprises a plate-fin heat exchanger.

35. The apparatus of claim 33, wherein said at least one mechanical refrigerant cycle includes a multiple stream generating system for separating the refrigerant associated with said at least one mechanical refrigeration cycle into said at least four distinct refrigerant streams.

36. The apparatus of claim 33, wherein said multiple stream generating system includes a plurality of serially connected expansion devices.

37. The apparatus of claim 36, wherein said multiple stream generating system includes at least one vapor/liquid phase separating drum located downstream of at least one of said expansion devices.

38. The apparatus of claim 33, further comprising a compressor operable to receive and compress at least a portion of each of said four distinct refrigeration streams after passage though said heat exchanging economizer.

39. The apparatus of claim 33, wherein said second mechanical refrigeration cycle employs said heat exchanging economizer, wherein said first refrigerant comprises predominately propane, propylene, ethane, and/or ethylene.

40. The apparatus of claim 39, wherein said second refrigerant comprises predominately ethane and/or ethylene.

41. The apparatus of claim 39, wherein said second refrigerant comprises predominately methane.

* * * * *

UNITED STATES PATENT AND TRADEMARK OFFICE

CERTIFICATE OF CORRECTION

PATENT NO. : 7,591,149 B2
APPLICATION NO. : 11/459500
DATED : September 22, 2009
INVENTOR(S) : Ransbarger et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 440 days.

Signed and Sealed this

Twenty-first Day of September, 2010

David J. Kappos

David J. Kappos
*Director of the United States Patent and Trademark Office*